US005162046A

United States Patent [19]

Mercado

[11] Patent Number: 5,162,046

[45] Date of Patent: Nov. 10, 1992

[54] METHOD FOR DYEING PET FILMS WITH SOLVENT DYE AND GLYCEROL TRIACETATE, (TRIACETIN)

[76] Inventor: Emilio A. Mercado, 1110-G Court Dr., Duluth, Ga. 30136

[21] Appl. No.: 767,501

[22] Filed: Sep. 30, 1991

[51] Int. Cl.[5] ..... D06P 3/52; C09B 67/00

[52] U.S. Cl. ..... 8/512; 8/495; 8/506; 8/582; 8/922; 8/933; 8/938

[58] Field of Search ..... 8/495, 512, 582

[56] References Cited

U.S. PATENT DOCUMENTS

| | | | |
|---|---|---|---|
| 4,215,992 | 8/1980 | Sato et al. | 8/445 |
| 4,581,035 | 4/1986 | Wilson | 8/508 |
| 4,602,916 | 7/1986 | Wilson | 8/580 |
| 4,609,375 | 9/1986 | Wilson et al. | 8/506 |
| 4,812,142 | 3/1989 | Brodmann | 8/512 |

*Primary Examiner*—A. Lionel Clingman

*Attorney, Agent, or Firm*—James B. Middleton

[57] ABSTRACT

A method of dyeing film of polyethylene terephthalate wherein the film is immersed in a dye bath of solvent dyes dissolved in a carrier consisting of glycerol triacetate, the dye bath being heated so the film is raised to the glass transition temperature of the film, and the dye and carrier are absorbed into the film. The dye and carrier are removed from the surface of the film by a washing bath, and the film is then heated to remove the carrier absorbed in the film without depreciating the dyestuff or the film.

8 Claims, 1 Drawing Sheet

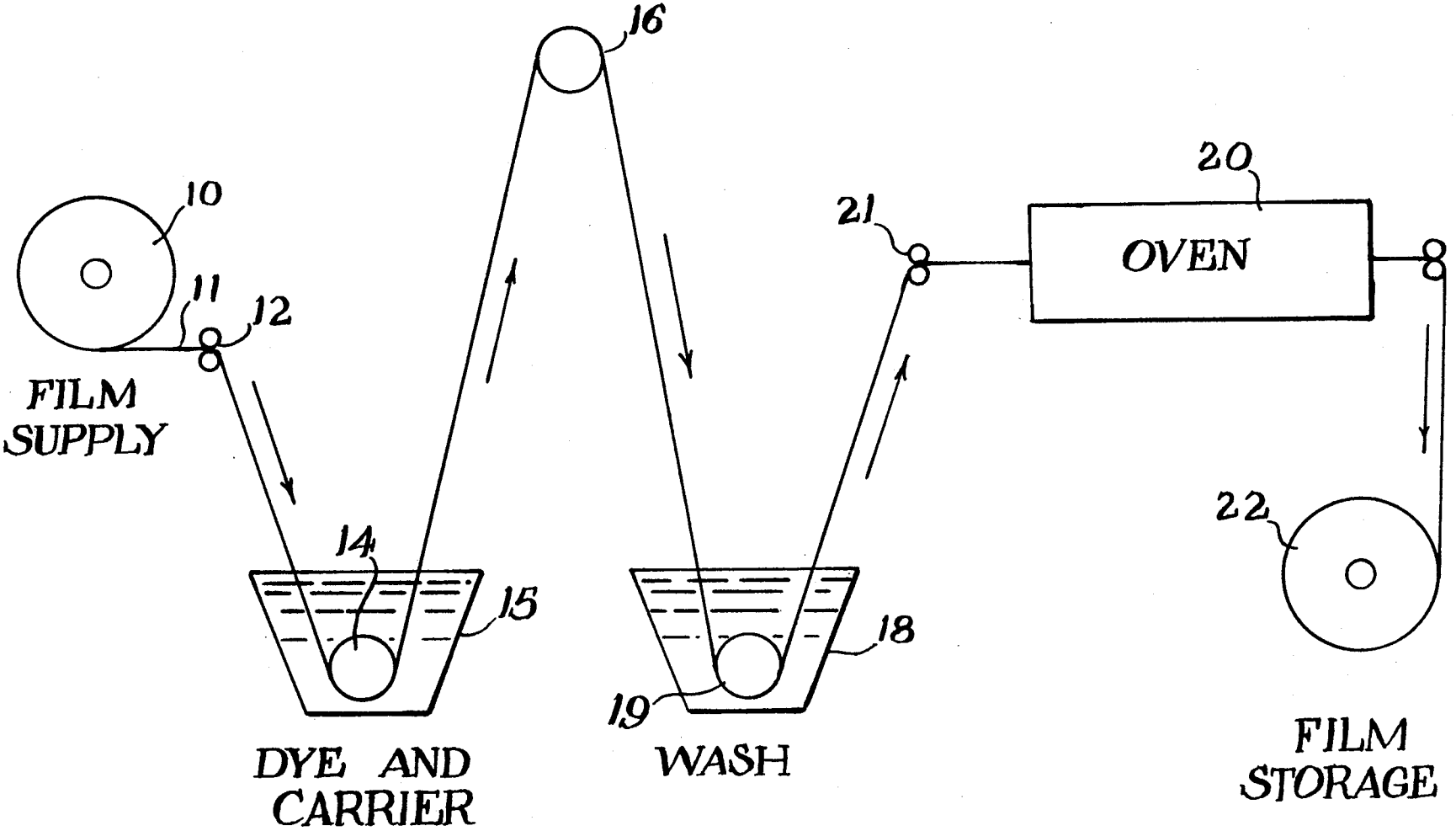
OVEN
20
21
22
FILM STORAGE
18
19
WASH
16
15
14
DYE AND CARRIER
10
11
12
FILM SUPPLY

METHOD FOR DYEING PET FILMS WITH SOLVENT DYE AND GLYCEROL TRIACETATE, (TRIACETIN)

INFORMATION DISCLOSURE STATEMENT

Films made of polyethylene terephthalate (PET) are in common use, and it is frequently desirable to have the films colored. The prior art techniques for coloring PET film include solution dyeing wherein dyes are mixed into the melt before the film is extruded, and a printing technique wherein color is laid onto the film, then set by heat. The solution dyeing yields excellent results, but it is impractical for small quantities of film, and colors cannot easily be changed between runs. The printing technique usually results in film having color on only one side, and it is difficult to get truly uniform color, or level dyeing.

Textile materials of PET are often dyed successfully, achieving level dyeing. Textile materials, however, are made of drawn fibers which are a crystalline form of PET. In the crystalline structure, dyestuff tends to be absorbed along the crystal boundaries. Since the crystalline grains are uniformly distributed throughout the material, the dye tends to be also uniformly distributed, yielding level dyeing. Contrarily, PET film has an amorphous structure. In the amorphous structure, dyestuff tends to be absorbed in the interstices of the polymer chains; and, since these chains are randomly distributed in the film, the dye tends to be randomly distributed, leading to an uneven coloring.

SUMMARY OF THE INVENTION

This invention relates generally to the dyeing of sheet material, and is more particularly concerned with a process for uniformly coloring a film of polyethylene terephthalate.

The present invention provides a method wherein a continuous film of polyethylene terephthalate (PET) is placed into a heated bath containing solvent dyes in a carrier that is a solvent for the dyes. The film is removed from the dye bath and briefly air dried, then washed in a bath of a solvent that is compatible with the PET film, the carrier and the dyestuffs. The dyed film is then heated to remove the carrier and any residual washing solvent, while leaving the absorbed dyestuffs.

The method of the present invention provides a level dyed PET film having substantially the same quality of the film as before dyeing. The color is uniform immediately after dyeing, and fades uniformly in sunlight or the like.

BRIEF DESCRIPTION OF THE DRAWING

These and other features and advantages of the present invention will become apparent from consideration of the following specification when taken in conjunction with the accompanying drawing in which:

The single FIGURE is a schematic diagram showing one form of apparatus for carrying out the method of the present invention.

DETAILED DESCRIPTION OF THE EMBODIMENT

Referring now more particularly to the drawing, and to that embodiment of the invention here chosen by way of illustration, the drawing shows a roll 10 of PET film as a source of film. Those skilled in the art will understand that any other source of film may be substituted, including an extrusion line so the film is dyed in line from the extruder.

From the roll 10, the film 11 passes through the nip of rolls 12 which will drive the film at the appropriate speed, and act as guide means for directing the film down to the immersion roll 14. The immersion roll 14 is within the container 15 so the film 11 is carried through the bath. The container 15 receives the solution of a high boiling carrier and dyestuffs. The bath is heated, so film 11 is heated to be more receptive to absorption of the liquid. It will of course be understood that the size of the container 15 and the speed of the film 11 can be varied to provide for the required immersion times to achieve the desired intensity of dyeing.

When the film 11 leaves the container 15, the film is directed over a roll 16, then to a second container 18 having an immersion roll 19 therein. The roll 16 is sufficiently removed from the containers 15 and 18 t o allow time for the film to dry before the film is immersed in the container 18.

The container 18 receives a washing liquid that is a solvent for the dyestuffs and for the carrier, but that will not attack or damage the PET film. The object of this washing step is to remove the excess dye and carrier that adheres to the surface of the film 11, while leaving the material that is absorbed into the film.

From the container 18, the film 11 is directed into an oven 20 by rolls 21. The purpose of the oven is to remove the carrier from the film 11 while leaving the dyestuffs. Thus, the temperature of the oven 20 will be above the flash point of the carrier, but the film will not be heated sufficiently to damage the film or the dyestuffs.

After the film 11 passes through the oven 20, it is directed to a roll 22 as a storage means, or to further processing if the dyeing process is being operated in line.

In carrying out the above described process, the first important feature is to provide the dye bath, which contains the carrier and the dyestuffs. The dyestuffs are solvent dyes, which are the same dyes used in solution dyeing of the film, adding color to the plastic melt. Solvent dyes include colors of the azo, quinoline anthraquinone, xanthene, aminoketone, perinone and azine chemical classes. Specific examples of solvent dyes for use in the present invention are as follows, listed by color index name:

| | |
|---|---|
| Solvent yellow | 33 |
| Solvent red | 23 |
| Solvent red | 24 |
| Solvent red | 111 |
| Solvent green | 3 |
| Solvent orange | 60 |
| Solvent blue | 11 |
| Solvent blue | 60 |
| Solvent blue | 102 |
| Solvent black | 5 |
| Solvent black | 7 |
| Solvent red | 1 |
| Solvent yellow | 14 |
| Solvent yellow | 16 |
| Solvent brown | 11 |

The carrier must be a solvent for the dyestuffs, and must have a boiling point high enough to allow appropriate heating of the carrier for the desired treatment temperature. The temperature range is generally in the range of the glass transition temperature for PET. The preferred treatment range is from 140° C. to 180° C. If the thickness of the film is below one mil (0.001"), the temperature will be in the lower end of the range.

The carrier for use in the present invention is preferably a high-boiling-point liquid polyhydric ether. The carrier may be any one of the ethers of glycerol, but the preferred carrier is glycerol triacetate, or triacetin. Though the ethers of glycerol in general will effect an acceptable dyeing of PET film in the process of the present invention, the use of triacetin yields superior results. Triacetin yields excellent saturation and levelness with a very short immersion time, and will dissolve solvent dyes at room temperature. Further, triacetin has a sufficiently high boiling point to allow treatment within a desirable operating range, but to be removed by temperatures in an acceptable range that will not damage the PET film or the dyestuffs.

In preparing the dye bath, for light colors, the concentrations may be in the range of 2–40 grams of dyestuff per liter of carrier. The temperature of the bath may be from 140°–180° C., and the required contact time is 5 seconds to 10 seconds. For deeper colors, the concentration can be increased to a range of 40–110 grams per liter, with a temperature in the range of 140°–180° C. The contact time may then be from 10 to 60 seconds.

The temperature of the dye bath is sufficient in the allotted time to raise the PET film to the glass transition temperature. In this range, the PET material expands to allow the dye bath to enter the material. Since the dyestuffs are in solution in the carrier, it will be understood that both the carrier and the dyestuff enters the PET film.

After the treatment in the dye bath, the PET film is removed and allowed to dry somewhat. At this point, the film 11 includes the solution of dye and carrier within the film, and also includes a quantity of the solution of dye and carrier adhering to the surface of the film. The solution adhering to the surface of the film is not necessarily uniformly distributed, so it is important to remove such material. To do so, the film is immersed in a washing bath.

The washing bath preferably comprises a material that will dissolve the adhering solution of dye and carrier, but will not attack, or degrade, the PET film. The washing bath should be a low boiling point liquid so it can be easily removed from the film. The alkane alcohols fit this description, and it has been found that ethanol yields excellent results. Methyl ethyl ketone (MEK) also yields stisfactory results.

After the film has been washed in the washing bath, the film is heated, as by the oven 20. Before the film 11 reaches the oven 20, the adherent dye solution has been removed by the washing bath; and, the washing bath is sufficiently volatile that it is easily removed. Those skilled in the art will realize that triacetin is a plasticizer for PET, so the presence of some triacetin within the film 11 will alter the physical properties of the film. One of the objects of the present invention is to produce dyed film that is substantially like the film before dyeing. Thus, the triacetin should be removed from the film 11. It is contemplated that the final heat treatment in the oven 20 will be carried out around 149° C. or above, and the film will be subjected to this temperature for about 3 to 30 seconds. If production demands require, the temperature may be increased, but the temperature should not exceed 175° C. because it is important not to cause any degradation of the PET film.

The heat treatment in the oven 20 is intended to remove the carrier from the film 11 without depreciating the film or the dyestuffs absorbed in the film. The flash point temperature of triacetin is within the glass transition temperature range of PET; therefore, so long as the selected dyestuffs can withstand this temperature range, the PET film can be dyed, and finally treated for removal of the carrier without damage to the film or the dyestuffs.

During the final heat treatment, it has been found that there is little or no dye migration. It is not known if the dyestuffs are simply physically trapped within the polymer voids, or if the dye is chemically attached to the polymer molecules, but the high quality of dyeing is not degraded by the final heat treatment.

In carrying out the present invention, it should be understood that the dyestuffs can be mixed, or blended, to create the desired color, and the process works quite well. Also, in changing colors, one must simply change the dye bath 15 and the wash bath 18, so a complete color change can be done quickly and easily. As a result, very short runs can be provided economically using the method of the present invention. A particular color mixture can even be saved for subsequent runs of the same color, and only the washing bath must be discarded.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. The method for dyeing polyethylene terephthalate film comprising the steps of heating said film to a temperature within the range of the glass transition temperature of said film, contacting said film with a solvent dye dissolved in a carrier while maintaining said film at said temperature within the range of the glass transition temperature of said film, removing the solvent dye and carrier from the surface of said film, and subsequently raising said film to a second temperature at least as high as the flash point of the carrier and in the range of the glass transistion temperature of said film to remove the carrier absorbed in said film, said carrier consisting of glycerol triacetate.

2. The method as claimed in claim 1, wherein the said step of removing the solvent dye and carrier from the surface of said film includes the step of immersing said film in a washing bath, said washing bath being selected from the group consisting of alkane alcohols and methyl ethyl ketone.

3. The method as claimed in claim 2, wherein said washing bath is selected from the group consisting of ethanol and methylethyl ketone.

4. The method as claimed in claim 3, wherein said washing bath consists of ethanol.

5. The method as claimed in claim 1, wherein the said step of raising said film to a second temperature comprises the steps of passing said film through an oven.

6. The method as claimed in claim 5, wherein said oven is heated to a temperature in the range of the glass transition temperature of said film.

7. The method as claimed in claim 6, wherein the said solvent dye dissolved in a carrier consists of from 2 to 110 grams of dye per liter of carrier.

8. The method as claimed in claim 7, wherein the said step of contacting said film with dye dissolved in a carrier comprises contacting said film for a period of time from 5 seconds to 60 seconds.

* * * * *